US005941299A

United States Patent [19]

Striuli et al.

[11] Patent Number: 5,941,299

[45] Date of Patent: Aug. 24, 1999

[54] METHOD FOR THE CONTROLLED PRE-ROLLING OF THIN SLABS LEAVING A CONTINUOUS CASTING PLANT

[75] Inventors: Mirco Striuli, S. Dona' Di Piave; Andrea Carboni, Milan; Alfredo Lavazza, Solbiate Olona; Umberto Meroni, Udine; Giovanni Coassin, Pordenone, all of Italy

[73] Assignee: Danieli & C. Officine Meccaniche SpA, Buttrio, Italy

[21] Appl. No.: 08/756,552

[22] Filed: Nov. 26, 1996

[30] Foreign Application Priority Data

| | | | |
|---|---|---|---|
| Nov. 28, 1995 | [IT] | Italy | UD95A0232 |
| Nov. 28, 1995 | [IT] | Italy | UD95A0233 |

[51] Int. Cl.[6] ..... B22D 11/12; B22D 11/16

[52] U.S. Cl. ..... 164/452; 164/476

[58] Field of Search ..... 164/452, 451, 164/476, 424, 417, 154.1, 154.4, 154.5, 154.7, 154.8

[56] References Cited

U.S. PATENT DOCUMENTS 5,018,569 5/1991 Burau et al. .

FOREIGN PATENT DOCUMENTS

| | | | |
|---|---|---|---|
| 0411962 | 2/1991 | European Pat. Off. . | |
| 0539784 | 5/1993 | European Pat. Off. . | |
| 0625388 | 11/1994 | European Pat. Off. . | |
| 2652020 | 3/1991 | France . | |
| 4436328 | 4/1995 | Germany . | |
| 56-111556 | 9/1981 | Japan . | |
| 57-68205 | 4/1982 | Japan . | |
| 58-13454 | 1/1983 | Japan . | |
| 63-238965 | 10/1988 | Japan . | |
| 63-242452 | 10/1988 | Japan | 164/452 |
| 63-286260 | 11/1988 | Japan | 164/476 |
| 1-271047 | 10/1989 | Japan . | |
| 4-322855 | 11/1992 | Japan | 164/476 |

*Primary Examiner*—J. Reed Batten, Jr.

*Attorney, Agent, or Firm*—Antonelli, Terry, Stout & Kraus, LLP

[57] ABSTRACT

The controlled pre-rolling of a slab, leaving a continuous casting plant is carried out with pairs of pre-rolling elements (14, 114, 16) assembled in at least one pre-rolling assembly (10), the first of these pre-rolling assemblies (10) being positioned immediately downstream of the foot rolls (12) of a crystalliser (11). At least one data processing and controlling unit (21) governs the positioning and the adjustment of the pre-rolling elements (14, 114, 16), the final pre-rolling zone being pre-defined by a specific pair (No. X) of pre-rolling elements positioned along the path of extraction of the slab (20), the data processing and controlling unit (21) having access to an inner memorised archive where there is a plurality of pre-defined tables or technological cards (27) containing the map of the desired values of reduction in thickness in the pre-rolling step as a function of the working parameters pre-set and/or monitored and/or detected continuously, each significant variation of at least two of these parameters causing a new table or technological card (27) to be selected with a resulting re-definition of the position and/or action of the pre-rolling elements (14, 114, 16).

10 Claims, 2 Drawing Sheets

METHOD FOR THE CONTROLLED PRE-ROLLING OF THIN SLABS LEAVING A CONTINUOUS CASTING PLANT

BACKGROUND OF THE INVENTION

This invention concerns a method for the controlled pre-rolling of thin slabs leaving a continuous casting plant.

To be more exact, the method according to the invention is carried out immediately downstream of the foot rolls of a mould on thin slabs leaving the mould performing continuous casting of thin slabs.

By thin slabs are meant slabs with a width from 800 to 2500 mm. or more and with a thickness from 25 to 90 mm.

The invention is applied advantageously, but not only, to slabs having a final thickness between 30 and 60 mm. at the outlet of the continuous casting machine.

The invention can also be applied to the continuous casting of billets, whether they be round, square, rectangular, etc.

The invention can be applied to straight and curved continuous casting plants.

EP-A-625.388 in the name of the present applicants discloses a controlled pre-rolling method whereby a thin slab is subjected to a pre-rolling action in a zone downstream of the foot rolls.

This document provides for the performance of a controlled pre-rolling with reduction with a liquid core, or soft reduction, of the slab leaving the crystalliser so as to produce a slab with a reduced thickness at the end of the casting machine.

As is disclosed in that prior art document, the main advantages of the controlled pre-rolling are the ability to obtain at the outlet of the casting machine a slab with a slender thickness (30–60 mm.) when using a crystalliser of a greater thickness, and also the ability to obtain a refining of the structure of solidification of the metal and the elimination of the central segregation in the slab.

The soft reduction, if it is to be effective, has to take place with a continuous controlled reduction of the thickness of the slab, and this condition can be achieved with a substantially tapered conformation of the segment of slab subjected to the soft reduction.

The above prior document states that this tapered segment has to have a length between about 0.8/1 meters and about 7 meters, in which the greater length corresponds to the end of the containing zone produced by idler containing rolls included downstream of the crystalliser and of the foot rolls.

Moreover, the pre-rolling method described in that document is based on an ON LINE solidification model which, on the basis of the actual casting conditions, determines the exact profile of solidification of the slab.

This method arranges to reduce in a controlled and required manner the thickness of the slab with a liquid core according to the main casting parameters (speed of extraction, difference of temperature in the tundish, secondary cooling downstream of the mould, type of steel, thicknesses) which are partly set at the start-up of the process and are partly continuously monitored by suitable sensors and/or transducers.

The rolls which perform the pre-rolling are associated with load cells and/or pressure transducers, which monitor the pressure exerted on the thin slab and check that this pressure, for each pair of rolls or for each assembly of pairs of rolls, corresponds to the pressure which the dynamic programme sets for obtaining the desired effect on the slab and for performing the desired pre-rolling.

Moreover, each pair of rolls is associated with a position transducer which monitors the distance or gap between the opposed rolls of each pair.

In this case too the task of the position transducer is primarily to check that the positioning of the pairs of rolls or of the assemblies of pairs of rolls corresponds to the value which the program sets for that pre-rolling cycle.

The whole system is governed by a data processing unit controlling the pre-rolling which receives signals from pressure transducers and position transducers, which may be transducers working with assemblies of rolls or with single rolls, and also from monitors of the speed of the slab, monitors of the secondary cooling parameters and monitors of the temperature of the molten metal in the tundish and of the temperature of the slab leaving the crystalliser.

There may also be included a monitor to identify the presence or absence of a liquid core within the slab.

The data processing and control unit of the prior art document processes these parameters and provides the pairs of rolls in real time with the best adjustment values.

By rolls are meant here continuous rolls, rolls covering sectors, belts, etc. that is to say, any system of the state of the art.

With the pre-rolling assembly are associated means for the secondary cooling of the slab which consist, for instance, of a plurality of sprayer nozzles.

Moreover, at least one descaling assembly may be associated with the pre-rolling assembly.

U.S. Pat. No. 5,018,569 discloses a pre-rolling method whereby the slab leaving a mould and the foot rolls is caused to cooperate with a plurality of pairs of successive rolls so as to achieve the desired reduction of thickness with a liquid core.

This document of the prior art arranges to identify and to determine the end of the liquid cone by reading the pressure exerted by the rolls on the slab passing through.

To be more exact, the adjustment of the hydraulic pressure of the actuator jacks associated with the rolls acting on the slab is set by a control element so as to obtain the desired reduction of thickness of the slab passing through.

However, in that document the opposed rolls of a pair are separated by stationary spacers and therefore can approach each other until the supports abut against these spacers.

Therefore, when the position of these spacers has been determined, the machine can no longer be adjusted and therefore cannot be adapted to the specific requirements which may occur from time to time.

Moreover, the adjustment and clamping in position of the rolls based only on the adjustment of the pressure of the actuator jacks is very unstable and not at all reliable.

In fact, the required pressure which the rolls have to exert on the slab changes during the casting steps in particular because in the various steps the temperature and the speed cannot always remain perfectly constant; these changes of pressure cannot be foreseen in so exact a manner as to be able to be balanced with variations of pressure in the adjustment actuator jacks and thus to enable the relative roll to remain in the desired position corresponding to that pre-rolling pass.

If the rolls do not remain fixed in the desired position, cracks and bends may be caused in the slab being processed.

In the case of this document of the prior art, when the pressure of the actuator jacks exceeds a given value, the speed of extraction is altered so as to alter the length of the liquid cone within the slab.

The alteration of the extraction speed, however, entails a plurality of drawbacks.

First of all, an alteration of the speed has an effect on all the working parameters and makes necessary a re-programming and a re-adaptation of the whole casting machine according to that alteration.

Furthermore, an alteration of speed may entail consequences regarding the quality of the product and the output of the plant.

Besides, each change of speed entails transient conditions which may alter the planar condition of the meniscus and therefore the surface quality of the cast product.

Moreover, the alteration of speed may be slow in terms of adaptation times, and this fact may entail a delay in reaching the conditions of the best disposition.

A further shortcoming of systems known to the state of the art, as has been demonstrated, is that the regulation of the position of the pre-rolling elements present downstream from the foot rolls, which is based exclusively or mostly on values obtained ON LINE and used in a dynamic programme continuously up-dated with the results of the monitoring, cannot always give satisfactory results.

In particular, in some cases there have been delays in adapting and regulating times, difficulties in obtaining the required precision, and malfunctionings deriving from the large amounts of calculations which have to be done every time one of the parameters being monitored is changed.

This means that extremely complex software has to be used, as the software has to elaborate a very large amount of data, re-calculate in real time the correct values of the reduction in thickness which has to be applied according to the parameters monitored, and then supply the output data to regulate and adapt a very high number of devices, all of which makes the machine too reactive and instable.

SUMMARY OF THE INVENTION

The present applicants have designed, tested and embodied this invention to overcome these drawbacks and to perfect the controlled pre-rolling method according to EP-A-625.388 and also to achieve further advantages.

The purpose of the invention is to obtain a method for the controlled pre-rolling of thin slabs leaving a continuous casting plant whereby the method perfects the system of dynamic adjustment of the action of the pre-rolling elements on the slab passing through.

In this invention, by pre-rolling elements are meant rolls, plates, belts, scraper blades or other means performing the same function.

A further purpose of the invention is to provide a method which reduces the complexity of the software to manage and control the system, and to reduce the amount of calculations which have to be carried out every time to regulate the position and/or function of the pre-rolling elements, yet maintain an efficient control and monitoring of the whole system.

In positioning and adjusting the pre-rolling elements, whether single or in assemblies, the method according to the invention, in a first embodiment, arranges to use a plurality of tables or technological cards pre-set by the technician and present in the memory of the data processing unit governing the means to position and adjust the pre-rolling elements.

In these tables or technological cards, the invention defines set values in relation to the reduction in thickness of the slab leaving the crystalliser, these values being referred to the distance starting from the outlet of the crystalliser.

In other words, each of these tables is pre-set by the technician, who knows the specific optimum conditions of pre-rolling based on data known in advance (type of steel, shape, temperature in the tundish, temperature of the slab, casting speed, cooling conditions, etc.); each of these tables then, contains the values relating to the progressive reduction of thickness that are required.

For example, it is possible to pre-set a reduction in thickness of 10% in the first two meters downstream of the crystalliser, a further reduction of 5% in the following two meters, and so on.

These fixed values for the reduction in thickness substantially correspond to the average optimum values foreseen in proportion to the principal parameters of the casting process, such as the temperature of the metal in the tundish, casting speed, parameters of primary and secondary cooling, type of steel, temperature of the slab leaving the crystalliser, parameters of the oscillation of the ingot mould, etc.

Every time, during the casting process, that a significant variation in at least two of these parameters is monitored, the data processing unit passes automatically, or by manual control, to a new table containing the fixed optimum values including the new value of the parameter which has changed.

All the other parameters being equal, each parameter continuously controlled and monitored will be associated with a plurality of tables, as many as are needed to contain all the different values which can cause a significant variation in the pre-rolling conditions.

In other words, for each of these parameters there will be a table which, with all the other parameters remaining fixed, will remain valid for a range of values included in a field of tolerance around an average value.

This solution makes it possible to reduce considerably the amount of calculations which have to be carried out every time there is a variation in the casting process, because everything is referred to a tabular selection of pre-set data, data which is certainly reliable because it is pre-set to ensure optimum pre-rolling conditions.

This also brings a reduction in the costs of the control system, and makes it possible, when so desired, to pass to a semi-automatic control (with a manual control of the tables) which is very efficient and simple to use.

In a further embodiment of the invention the pre-rolling passes are adjusted dynamically by the data processing unit according to the signals received and indicating the actual force of closure of the rolls against the slab.

These signals are obtained, in a manner disclosed in EP-A625.388, by measuring the pressure acting in the hydraulic actuator jacks which act on the pre-rolling rolls, or else by means of load cells coupled directly to those rolls.

When these signals indicate that the force of closure is greater than a pre-set threshold, as a function of the ferrostatic pressure at that point, this indicates that the rolls are acting on a slab which is already fully solidified.

In this case the final pre-rolling zone is displaced onto the pair of adjustable rolls positioned immediately upstream.

Monitoring of the threshold value is repeated until the force of closure found at a given pair of rolls does not go below that threshold value.

When this situation is found, the disposition of the casting machine stabilises and is maintained until a new condition of exceeding the threshold occurs.

According to a variant, two thresholds are provided, namely a maximum threshold and a minimum threshold.

In this case, when the force of closure measured exceeds the maximum threshold value, the final pre-rolling zone is displaced to the pair of adjustable rolls positioned immediately upstream, whereas when the force of closure descends below the minimum threshold value, the final pre-rolling zone is displaced to the pair of adjustable rolls positioned immediately downstream.

In a limit condition these two thresholds may coincide.

According to another preferred embodiment of the invention the pre-rolling passes are adjusted dynamically by the data processing unit according to the signals received from the position transducers and indicating the actual position of the rolls in relation to the slab.

On the basis of this monitoring, the casting machine adapts the configuration of the pairs of rolls dynamically when the data processing unit discloses that the actual distance between the opposed rolls of each pair is greater, after allowing for a pre-set value of tolerance, than the pre-set value for that specific pair.

This signal indicates the fact that the rolls are acting on a slab which is already fully solidified.

In this case, therefore, the set value of the distance between the opposed rolls of a pair is used for the pair of rolls positioned upstream, and so on until the best configuration conditions set for the pre-rolling are re-established.

In the method according to the invention the length of the soft reduction zone is between 0.3 and 14 meters, depending on the casting parameters relating at least to the extraction speed, the intensity of cooling, the type of steel and the thicknesses in question.

This long pre-rolling segment makes possible a wider and more flexible range of options of the working conditions of the rolls and also a better and more extended distribution of the action of the pre-rolling assemblies on the slab being extracted.

Besides, the surface tensions on the material and the forces supported by the rolls during working are less, and therefore there is less overheating of the rolls and a longer working life thereof.

In one variant of the method according to the invention at least some of the rolls or assemblies of rolls forming the pre-rolling elements located downstream of the foot rolls and having the task of carrying out in a controlled manner the reduction of the slab with a liquid core are powered.

In another variant at least one containing scraper means is included as an element to replace or complement the rolls and not only performs in a desired manner the action of reduction with a liquid core but also exerts on the slab passing through an action of removing the scale and residues of lubrication slag on the surface of the slab.

BRIEF DESCRIPTION OF THE DRAWINGS

The attached figures, which are given as a non-restrictive example, show a preferred solution of the method according to the invention as follows.

DETAILED DESCRIPTION OF THE PREFERRED EMBODIMENTS

Figure 1:
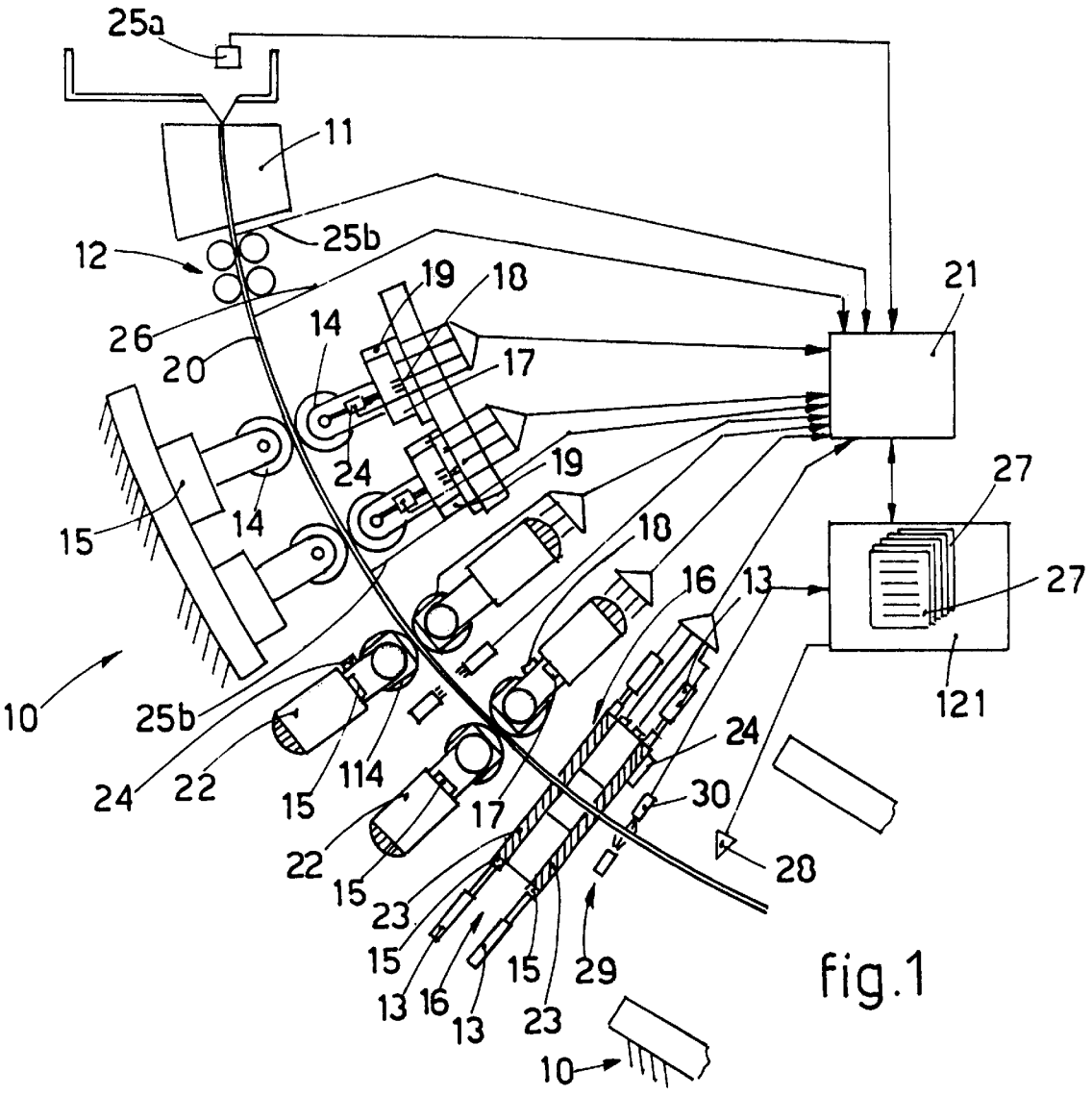
FIG. 1 is a part view of a pre-rolling assembly according to the invention.

In FIG. 1 the pre-rolling method according to the invention is carried out by at least one pre-rolling assembly 10 consisting of a plurality of pairs of rolls 14.

This pre-rolling method is performed so as to reduce progressively the thickness of a slab 20 leaving a crystalliser 11 to a desired value; this reduction may amount to between 10% and 50% of the value of the thickness of the slab 20.

FIG. 1 shows only the first of the pre-rolling assemblies 10 associated with foot rolls 12 and with a crystalliser 11, which produces continuously a thin slab 20; a second pre-rolling assembly 10 installed immediately downstream is only partly shown.

The first pre-rolling assembly is fitted immediately downstream of the crystalliser 11 at a distance of about 0.3 to 0.4 meters.

In the form of embodiment shown merely as an example the first pre-rolling assembly 10 comprises two pairs of idler rolls 14 followed by two pairs of powered rolls 114 associated with respective motors 22 and by a scraper means 16, which also has the function of reducing the thickness of the slab 20 being extracted.

The pairs of rolls 14, 114 shown can be continuous assemblies or be divided into sectors or into assemblies of two or more pairs or be of any known type.

The rolls 14, 114 and the blades 23 of the scraper means 16 are associated singly or in assemblies with at least one load cell 15, which sends signals to a data processing unit 21 controlling the pre-rolling means.

In the form of embodiment shown the rolls 14, 114 are associated singly or in assemblies with at least one capsule or hydraulic actuator jack 17, whereas the blades 23 of the scraper means 16 are associated with hydraulic actuator jacks 13 or with screw-threaded type jacks.

Each actuator jack 13, 17 is controlled by a servovalve 19 and is associated with a pressure transducer 18; the servovalves 19 are controlled by the data processing and controlling unit 21 of the pre-rolling means, so that the unit 21 obtains the data relating to actual force of closure exerted by the rolls 14, 114 and by the blades 23 against the slab 20.

In this case each pair of rolls 14, 114 and the scraper means 16 are associated with their own individual position transducers 24.

Further position transducers working with the assemblies of rolls may be included but are not shown in this case.

Each pressure transducer 18, each individual position transducer 24 and each possible position transducer working with an assembly transmit their own signals to the data processing and controlling unit 21.

In order to control the pre-rolling process and obtain the desired reduction in the thickness of the slab 20, the method includes monitors of the temperature 25*a* in a tundish and 25*b* at the outlet of the crystalliser 11, speed monitors 26, monitors 28 of the liquid core and means 29 to adjust the secondary cooling with nozzles 30, all these monitors and means sending and/or receiving signals to/from the data processing and controlling unit 21.

At the beginning of a rolling campaign there are set or inserted in the data processing and controlling unit 21 the parameters linked to the pre-rolling which it is intended to carry out, these parameters being possibly associated with the type of material cast and with the dimensions of the thin slab 20.

As a function of these parameters the data processing and controlling unit 21 pre-arranges the configuration of the pairs of rolls 14, 114 and of the scraper means 16 so as to obtain the desired pre-rolling passes, and in particular the pair of rolls is selected, indicated in this case generically with No. X, in which there is the end of the pre-rolling, that is to say, in which there is a fully solidified slab 20.

Figure 2:
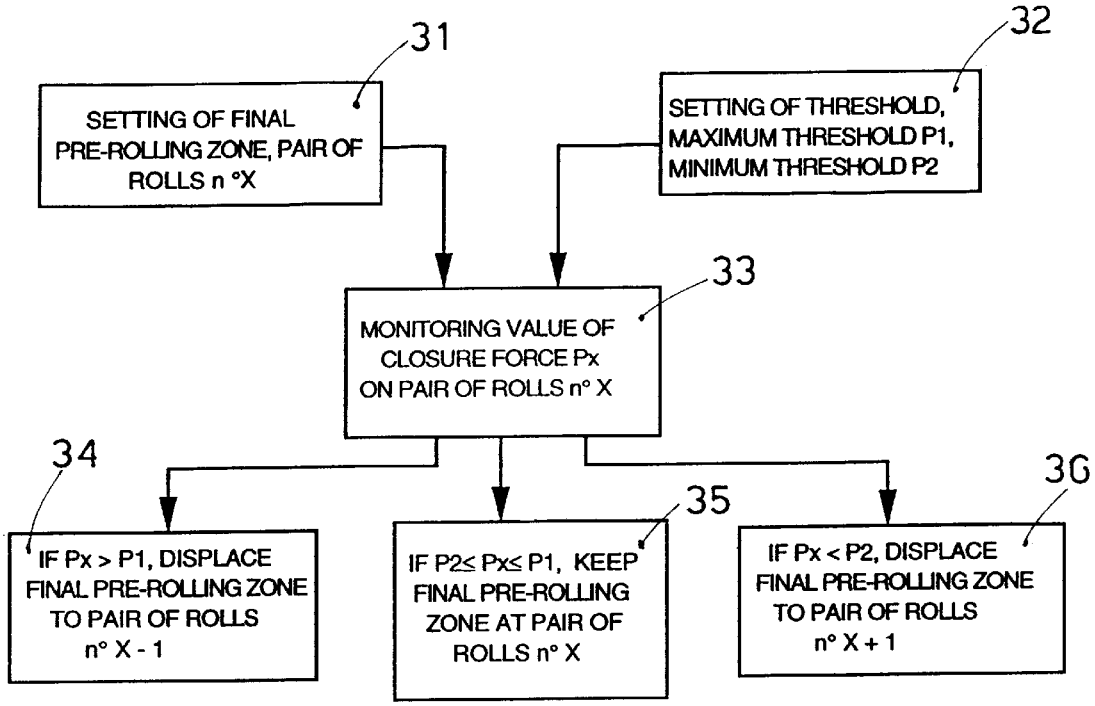
FIGS. 2 and 3 are block diagrams of two preferred solutions of the invention.
Figure 3:
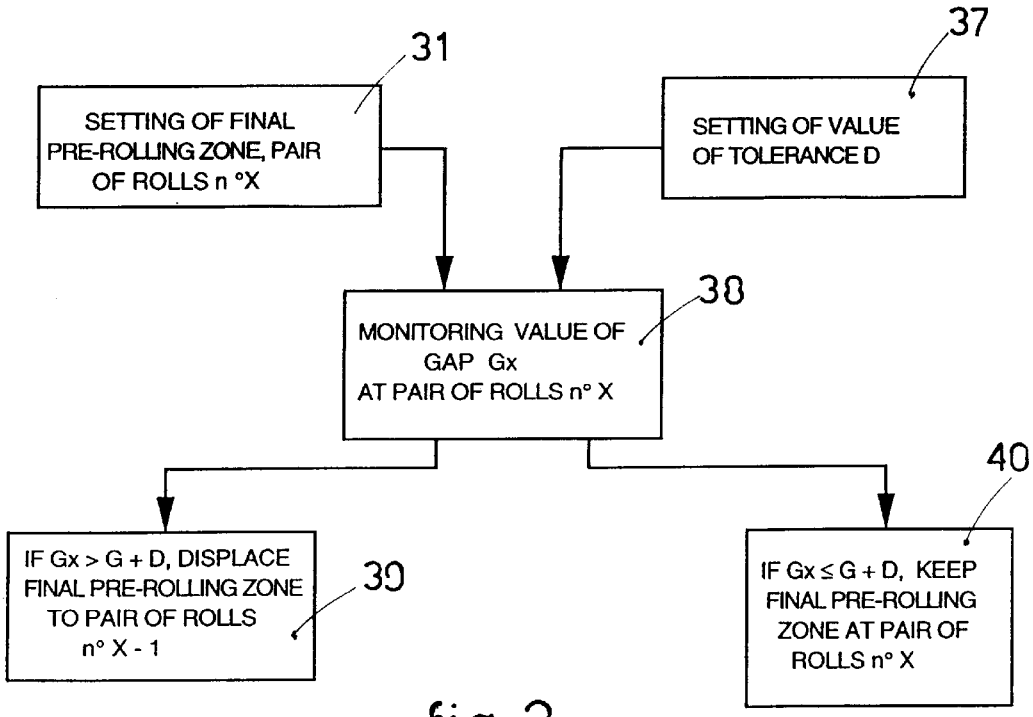

This step is referenced with the pass 31 in FIGS. 2 and 3.

The data processing and controlling unit 21 intervenes, if necessary, to modify the configuration of the pre-rolling elements 14, 114, 16, in this case, based on a specific and pre-determined table, or technological card, 27 contained, in this case, in the memory of the central data processing unit 121; when casting is started, when the dummy bar is extracted, the data processing and controlling unit 21 controls and adjusts, one by one, the pairs of rolls 14, 114, and the scraping device 16 in such a way that the desired pre-rolling is achieved.

In the event that at least two of the continuously monitored parameters are subject to variation, be it natural, accidental or imposed from outside, in relation to the pre-set value, the data processing and controlling unit 21 selects a new table 27 which is present in the memory, or inner archive, of the central processing unit 121; this new table 27 will contain inside, as identification data, the parameters monitored during processing, with the value which has varied as monitored by the relative monitoring means and, as output data, the values to position and adjust the pre-rolling elements 14, 114, 16.

According to this embodiment, each variation outside a defined field of at least two of the parameters monitored causes a new table 27 to be selected, this new table 27 having the new values to position and adjust the pre-rolling elements 14, 114, 16 in their entirety.

The data processing and controlling unit 21 can also act on the motors 22 of the powered rolls 114 and if necessary on the jacks 13, of the screw threaded or hydraulic type, associated with the blades 23 of the scraping device 16.

In this case, both the flow and the pressure of delivery of the sprayer nozzles 30 of the secondary cooling means 29 are advantageously adjusted by the data processing and controlling unit 21 and/or the central processing unit 121, thus ensuring a continuous monitoring of the conditions of the slab 20.

According to the programme pre-set in the data processing and controlling unit 21 or 121, the reduction in thickness can be progressive with a constant gradient or in sections with a different gradient of reduction.

In a further solution of the invention shown in FIG. 2, in an initial step two thresholds (pass 32) are pre-arranged, namely a maximum P1 and a minimum P2 respectively, which correspond to values of the force of closure which the rolls 14, 114 or the other pre-rolling elements, such as the blades 23, for instance, exert on the surface of the slab 20.

During the process the values corresponding to the force of closure for each pair of pre-rolling elements are monitored continuously by controlling the pressure in the hydraulic actuator jacks 17, 13 or else by controlling the monitoring performed by the load cells 15.

In particular, there is checked the value of the force of closure Px found at the pair of rolls No. X in relation to the thresholds P1 and P2 (pass 33).

As can be seen in FIG. 2 (pass 34), if the force of closure Px is greater than the maximum threshold P1, this means that the rolls are acting on a slab 20 which has already become solidified, and therefore the final zone of the pre-rolling is displaced to the pair of rolls No. X−1 positioned immediately upstream.

If the force of closure Px lies between the two thresholds P1 and P2, then the disposition of the pre-rolling elements is not changed (pass 35), whereas if the force of closure Px is less than the minimum threshold P2, this means that the liquid core exceeds the programmed value and that therefore the final zone of pre-rolling is to be displaced to the pair of rolls No. X+1 positioned immediately downstream (pass 36).

These steps of checking are carried out until the condition corresponding to the pass 35 is found.

In a conceptually analogous manner, which may be an alternative or complementary to what we have said above, the dynamic checking of the correct development of the pre-rolling may be carried out on the basis of the actual values of the gap, or distance, between the opposed rolls as monitored by the position transducers 24, whether the latter be monitors of individual rolls or of assemblies of rolls.

In this case, in the initial pre-arrangement step a value of tolerance D (pass 37) is set which, for instance, is calculated as a fixed percentage of the gap G or according to precise and specific algorithms of calculation.

During the process the actual value of the gaps and in particular the value of the gap Gx corresponding to the pair of rolls positioned in the zone designated as the final pre-rolling zone (pass 38) is continuously checked.

In this case, as can be seen in FIG. 3, if the actual value of the gap Gx exceeds the value G plus the set tolerance D, this means that the rolls are acting on a slab which is already solidified, and therefore the final pre-rolling zone is displaced to the upstream pair of rolls No. X−1 (pass 39).

If the contrary is the case, the disposition of the machine is kept as previously pre-arranged by the data processing unit 21 (pass 40).

All the above adjustments can be achieved dynamically by recalculating on the basis of the new monitored parameters the entire disposition of the casting machine or else by selecting the tables 27 described above.

The method according to the invention provides for the pre-rolling of the slab 20 to be able to be carried out up to a distance of about 14 meters from the outlet of the crystalliser 11 by using pre-rolling assemblies 10 positioned in sequence and comprising only idler 14 or powered 114 rolls or else rolls positioned alternately with containing scraper means 16.

We claim:

1. Method for the controlled pre-rolling of a slab leaving a continuous casting plant, comprising pre-rolling the a slab with pairs of pre-rolling elements assembled in at least one pre-rolling assembly, a first of these pre-rolling assemblies being positioned immediately downstream of foot rolls of a crystalliser, all or a part of these pre-rolling elements being associated with at least pressure transducer means, hydraulic actuator jack means and position transducer means, there being also included means monitoring the liquid core within the slab, means monitoring the temperature in a tundish feeding the crystalliser and means monitoring the temperature of the slab, both as it leaves the crystalliser and when it is inside the at least one pre-rolling assembly, there also being included means monitoring the parameters of secondary cooling, and means monitoring the casting speed, all these transducer and/or monitoring means being connected to at least one data processing and controlling unit, and governing the positioning and the adjustment of the pre-rolling elements with the data processing and controlling unit, the final pre-rolling zone being pre-defined by a specific pair (No. X) of pre-rolling elements positioned along the path of extraction of the slab, wherein the data processing and controlling unit has access to an inner memorised archive where there is a plurality of pre-defined tables or technological cards containing the map of the desired values of reduction in thickness during pre-rolling, as a function of working parameters, the working parameters including at least two of the temperature of the melted metal in the tundish, the temperature of the slab as it leaves the crystalliser, the temperature of the slab at several points along the pre-rolling step, the casting speed, the parameters of secondary cooling, the type of steel, the presence and/or entity of a liquid core inside the slab, the parameters of primary cooling, and the course and frequency of the oscillations to which the crystallizer is subject, each significant variation of at least two of these parameters causing a new table or technological card to be selected with a resulting re-definition of the position and/or action of the pre-rolling elements.

2. Method as in claim 1, in which each variation of at least one of the plurality of working parameters outside a field of tolerance pre-defined around an average value, with all the other parameters being equal, causes a new table or technological card to be selected.

3. Method as in claim 1, in which the reduction in thickness of the slab is obtained in a travel which can vary from a minimum distance of 0.3 meters to a maximum distance of 14 meters from the outlet of the crystalliser.

4. Method as in claim 1, in which during the process the data processing and controlling unit receives continuously the actual values relating to the closure force (P) and/or the gap (G) at least of the pair (X) of pre-rolling elements positioned at the final pre-rolling zone, those values being respectively (Px) and (Gx), compares those values with pre-set threshold values and configures the disposition of all the pairs of pre-rolling elements included on the path of extraction on the basis of that comparison.

5. Method as in claim 4, in which if the closure force (Px) is greater than the value of the maximum pre-set threshold (P1) the data processing and controlling unit (21) displaces the final pre-rolling zone to the pair of rolls (X−1) positioned immediately upstream and repeats the operation n times until (Px) (pass n)≦(P1) is obtained.

6. Method as in claim 5, in which if the closure force (Px) is less than the value of the minimum pre-set threshold (P2), the data processing and controlling unit (21) displaces the final pre-rolling zone to the pair of rolls (X+1) positioned immediately downstream and repeats the operation n times until (P2)≦(Px) (pass n)≦(P1) is obtained.

7. Method as in claim 6, in which (P1=P2).

8. Method as in claim 4, in which if the gap (Gx) is greater than the pre-set value (G1) increased by a pre-set value of tolerance (D), the data processing and controlling unit (21) displaces the final pre-rolling zone to the pair of rolls (X−1) positioned immediately upstream and repeats the operation n times until (Gx) (pass n)≦(G1)+(D) is obtained.

9. Method as in claim 8, in which the value of tolerance (D) is obtained as a percentage of the value of the relative gap (G).

10. Method as in claim 4, in which the reduction of the thickness of the slab is achieved in a travel which may vary from a minimum distance of 0.3 meters to a maximum distance of 14 meters starting from the outlet of the crystalliser.

* * * * *